US009756428B1

(12) United States Patent
Tseng et al.

(10) Patent No.: US 9,756,428 B1
(45) Date of Patent: Sep. 5, 2017

(54) ELECTRO-ACOUSTIC TRANSDUCER

(71) Applicant: GlobalMEMS Co., Ltd., Grand Cayman (KY)

(72) Inventors: Shih-Hsiung Tseng, New Taipei (TW); Ming-Ching Wu, Taoyuan (TW)

(73) Assignee: GlobalMEMS Co., Ltd., Grand Cayman (KY)

( * ) Notice: Subject to any disclaimer, the term of this patent is extended or adjusted under 35 U.S.C. 154(b) by 0 days.

(21) Appl. No.: 15/099,617

(22) Filed: Apr. 15, 2016

(30) Foreign Application Priority Data

Feb. 16, 2016 (TW) ..... 105104416 A

(51) Int. Cl.
*H04R 25/00* (2006.01)
*H04R 3/00* (2006.01)
*H04R 17/02* (2006.01)

(52) U.S. Cl.
CPC ..... *H04R 17/02* (2013.01); *H04R 3/005* (2013.01); *H04R 2400/01* (2013.01)

(58) Field of Classification Search
USPC ..... 381/190, 191, 173, 174; 257/416–419; 310/328, 324
See application file for complete search history.

(56) References Cited

U.S. PATENT DOCUMENTS

2013/0329920 A1* 12/2013 Grosh ..... H04R 17/00 381/173

FOREIGN PATENT DOCUMENTS

TW I520625 2/2016

OTHER PUBLICATIONS

"Office Action of Taiwan Counterpart Application," dated Feb. 9, 2017, p. 1-p. 4, in which the listed reference was cited.

* cited by examiner

*Primary Examiner* — Sunita Joshi
(74) *Attorney, Agent, or Firm* — Jianq Chyun IP Office

(57) ABSTRACT

An electro-acoustic transducer includes a base, a plurality of vibration portions and a connection portion. Each of the vibration portion includes a piezoelectric transduction layer and has a first connection end and a second connection end opposite to each other, and the first connection ends are connected to the base. The connection portion is separated from the base and connected to the second connection ends. The piezoelectric transduction layers are adapted to receive electrical signals to deform, such that the vibration portions are driven to vibrate and generate corresponding acoustic waves. The vibration portions are adapted to receive acoustic waves to vibrate, such that the piezoelectric transduction layers are driven to deform and generate corresponding electrical signals.

6 Claims, 4 Drawing Sheets

ELECTRO-ACOUSTIC TRANSDUCER

CROSS-REFERENCE TO RELATED APPLICATION

This application claims the priority benefit of Taiwan application serial no. 105104416, filed on Feb. 16, 2016. The entirety of the above-mentioned patent application is hereby incorporated by reference herein and made a part of this specification.

BACKGROUND

Field of the Invention

The invention relates to an electro-acoustic transducer and more particularly, to a piezoelectric type electro-acoustic transducer.

Description of Related Art

An electro-acoustic transducer can be applied to a sound input device, e.g., a microphone, and a sound output device, e.g., a speaker. Taking a piezoelectric type electro-acoustic transducer as an example, an electrical signal is applied to an upper and a lower electrodes of a piezoelectric material to deform the piezoelectric material by utilizing a transverse piezoelectric effect of the piezoelectric material, such that a corresponding vibration membrane is driven to vibrate and generate a corresponding acoustic wave. Otherwise, an acoustic wave may also be applied to the vibration membrane, such that the corresponding piezoelectric material are driven to vibrate and deform to generate a corresponding electrical signal by utilizing the direct piezoelectric effect of the piezoelectric material.

Consumer electronic products, such as smart phones, notebook computers, tablet PCs, are commonly equipped with microphones and speakers. Under the trend that consumers chase for high quality and multi-functional consumer electronic products, the industry looks forward to applying advanced technologies to develop and manufacture electro-acoustic transducers applicable to the microphones and the speakers, so as to enhance product competitiveness in the market. Therefore, how to effectively improve electro-acoustic transduction efficiency of the sound input/output devices is an important subject of the research and development (R&D) field of the electro-acoustic transducers.

SUMMARY

The invention provides an electro-acoustic transducer having good electro-acoustic transduction quality.

The electro-acoustic transducer of the invention includes a base, a plurality of vibration portions and a connection portion. Each of the vibration portions includes a piezoelectric transduction layer and has a first connection end and a second connection end opposite to each other, and the first connection ends are connected to the base. The connection portion is separated from the base and connected to the second connection ends. The piezoelectric transduction layers are adapted to receive electrical signals to deform, such that the vibration portions are driven to vibrate and generate corresponding acoustic waves. The vibration portions are adapted to receive acoustic waves to vibrate, such that the piezoelectric transduction layers are driven to deform and generate corresponding electrical signals.

In an embodiment of the invention, the base has an opening, the vibration portions and the connection portion are located in the opening, and the first connection ends are connected to an inner edge of the opening.

In an embodiment of the invention, the vibration portions surround the connection portion.

In an embodiment of the invention, each of the vibration portions further includes a carrying layer, the piezoelectric transduction layer is disposed on the carrying layer, the piezoelectric transduction layer is adapted to deform relatively to the carrying layer to drive the vibration portion to vibrate, and the vibration portion is adapted to vibrate to drive the piezoelectric transduction layer to deform relatively to the carrying layer.

In an embodiment of the invention, a material of the carrying layers includes a non-piezoelectric material.

In an embodiment of the invention, each of the piezoelectric transduction layers includes an upper electrode layer, a piezoelectric material layer and a lower electrode layer, and the piezoelectric material layer is disposed between the upper electrode layer and the lower electrode layer.

In an embodiment of the invention, the upper electrode layer includes a first electrode region and a second electrode region, the first electrode region and the second electrode region are separated from each other, the first electrode region is aligned with the first connection end, and the second electrode region is aligned with the second connection end and the connection portion.

In an embodiment of the invention, the first electrode region is adapted to receive or output an electrical signal, the second electrode region is adapted to receive or output another electrical signal, and phases of the two electrical signals are reversed.

To sum up, in the electro-acoustic transducer of the invention, each of the vibration portions is not only connected to the base through the first connection end thereof, but also connected to the other vibration portions through the second connection end thereof and the connection portion. Namely, the first connection end and the second connection end of each of the vibration portions are not free ends. When receiving acoustic waves or being actuated by electrical signals, the first connection end and the second connection end can generate stresses in reversed directions. In this way, electrical signals with reversed phases can be respectively input from the first connection end and the second connection end to each piezoelectric transduction layer, such that strains are generated respectively at the first connection end and the second connection end of the piezoelectric transduction layer to drive the vibration portion to vibrate, and the electrical signals are input in a differential manner to the electro-acoustic transducer. Thereby, strength and accuracy of outputting the acoustic waves can be improved. In addition, when each vibration portion receives acoustic waves to drive the piezoelectric transduction layer to deform, strains and electrical signals with reversed phases are generated respectively at the first connection end and the second connection end of the piezoelectric transduction layer, and the electrical signals are output in a differential manner. Thereby, strength and accuracy of outputting the acoustic waves can be improved. In this way, the electro-acoustic transducer can have good electro-acoustic transduction quality.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
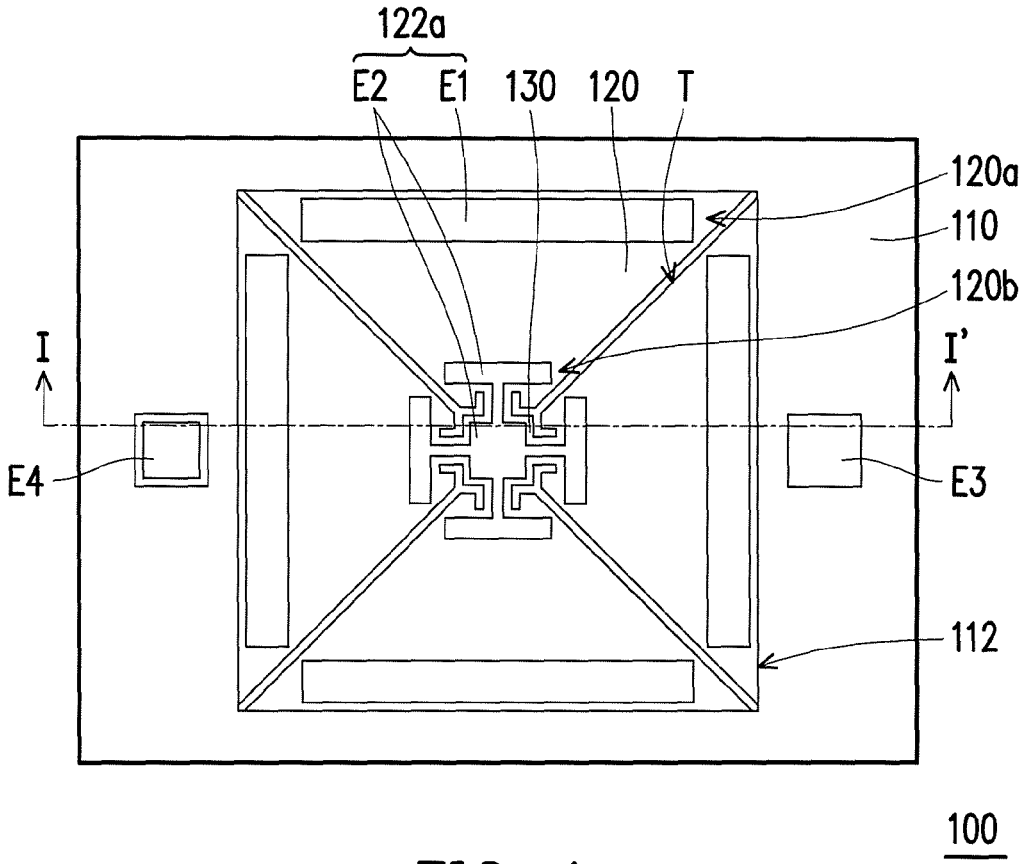
FIG. 1 is a schematic top view illustrating an electro-acoustic transducer according to an embodiment of the invention.
Figure 2:
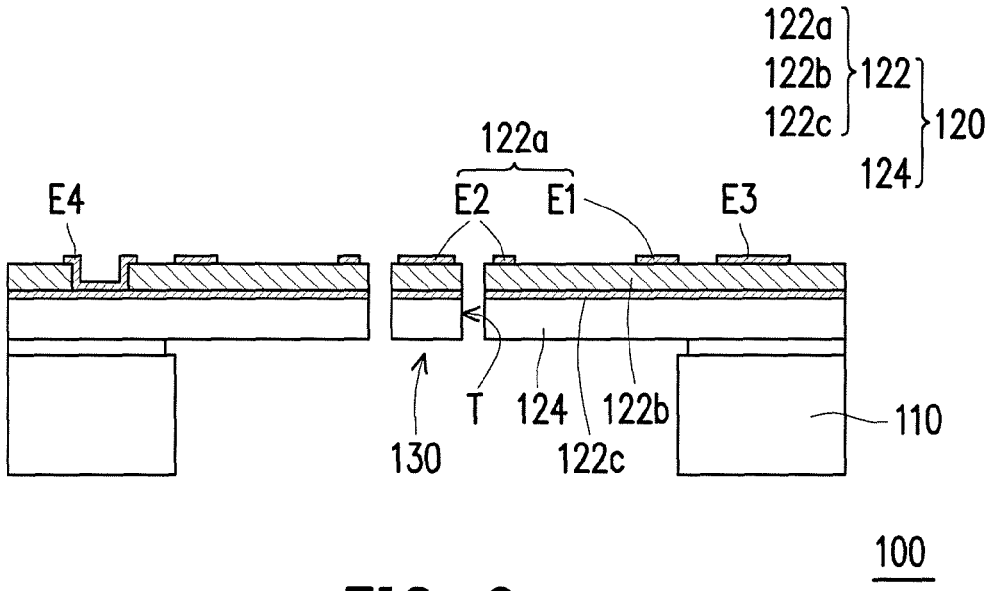
FIG. 2 is a schematic cross-sectional view of the electro-acoustic transducer depicted in FIG. 1 along line I-I.

FIG. 1 is a schematic top view illustrating an electro-acoustic transducer according to an embodiment of the invention. FIG. 2 is a schematic cross-sectional view of the electro-acoustic transducer depicted in FIG. 1 along line I-I. Referring to FIG. 1 and FIG. 2, an electro-acoustic transducer 100 of the present embodiment is manufactured by, for example, a micro electro mechanical system (MEMS) process and may be applied to a sound input device (e.g., a microphone), a sound output device (e.g., a speaker) or an ultrasound transducer. The electro-acoustic transducer 100 includes a base 110 and a plurality of vibration portions 120 (illustrated as four herein) and a connection portion 130. Each of the vibration portions 120 includes a piezoelectric transduction layer 122 (which is illustrated in FIG. 2). The piezoelectric transduction layers 122 are adapted to receive electrical signals to deform, such that the vibration portions 120 are driven to vibrate and generate corresponding acoustic waves. In addition, the vibration portions 120 are adapted to receive acoustic waves to vibrate, such that the piezoelectric transduction layers 122 are driven to deform and generate corresponding electrical signals.

In the present embodiment, each of the vibration portions 120 has a first connection end 120*a* and a second connection end 120*b* opposite to each other. The first connection ends 120*a* are connected to the base 110. The connection portion 130 is separated from the base 110 and connected to the second connection ends 130*b*(120*b*?). In this disposition manner, the first connection end 120*a* and the second connection end 120*b* of each of the vibration portions 120 are not free ends, and when receiving acoustic waves or being actuated by electrical signals, the first connection end 120*a* and the second connection end 120*b* generate stresses in reversed directions. In this way, electrical signals with reversed phases may be respectively input from the first connection end 120*a* and the second connection end 120*b* to each piezoelectric transduction layer 122, such that strains are generated respectively at the first connection end 120*a* and the second connection end 120*b* of the piezoelectric transduction layer 122 to drive the vibration portion 130 to vibrate, and the electrical signals are input in a differential manner to the electro-acoustic transducer 100. Thereby, strength and accuracy of outputting the acoustic waves may be improved. In addition, when each vibration portion 120 receives acoustic waves to drive the piezoelectric transduction layer 122 to deform, strains and AC electrical signals with reversed phases are generated respectively at the first connection end 120*a* and the second connection end 120*b* of the piezoelectric transduction layer 122, and the electrical signals are output in a differential manner. Thereby, strength and accuracy of outputting the acoustic waves may be improved. In this way, the electro-acoustic transducer 100 may be provided with good electro-acoustic transduction quality.

In the present embodiment, referring to FIG. 1, the base 110 has an opening 112, the vibration portions 120 and the connection portion 130 are located in the opening 112, the first connection ends 120*a* are connected to an inner edge of the opening 112, and the vibration portions 120 surround the connection portion 130. In addition, each of the vibration portions 120 further includes a carrying layer 124, as illustrated in FIG. 2. The piezoelectric transduction layer 122 is disposed on the carrying layer 124, the piezoelectric transduction layer 122 is adapted to expandably and contractibly deform relatively to the carrying layer 124, such that the vibration portion 120 is driven to vibrate, and the vibration portion 120 is adapted to receive acoustic waves to vibrate, such that the piezoelectric transduction layer 122 is driven to expandably and contractibly deform relatively to the carrying layer 124 and accordingly generate corresponding electrical signals. The carrying layer 124 is, for example, a device layer made of silicon on insulator (SOI) or other adaptive non-piezoelectric materials, but the invention is not limited thereto. The base 110 is, for example, a handle layer made of SOI or other adaptive materials, which is not limited in the invention.

To be more detailed, each of the piezoelectric transduction layers 122 of the present embodiment includes an upper electrode layer 122*a*, a piezoelectric material layer 122*b* and a lower electrode layer 122*c*. The piezoelectric material layer 122*b* is disposed between the upper electrode layer 122*a* and the lower electrode layer 122*c*. A material of the upper electrode layer 122*a* includes, for example, but not limited to, gold (Au). The upper electrode layer 122*a* includes a first electrode region E1 and a second electrode region E2, the first electrode region E1 and the second electrode region E2 are separated from each other, the first electrode region E1 is aligned with the first connection end 120*a*, and the second electrode region E2 is aligned with the second connection end 120*b* and the connection portion 130. A material of the lower electrode layer 122*c* includes, for example, but not limited to, platinum (Pt). Moreover, the upper electrode layer 122*a* and the lower electrode layer 122*c* further extend to places above the base 100 and respectively have an electrode E3 and an electrode E4 above the base 110. Electrical signals may be may input into or output from the electro-acoustic transducer 100 through the first electrode region E1, the second electrode region E2, the electrodes E3 and E4.

Figure 3:
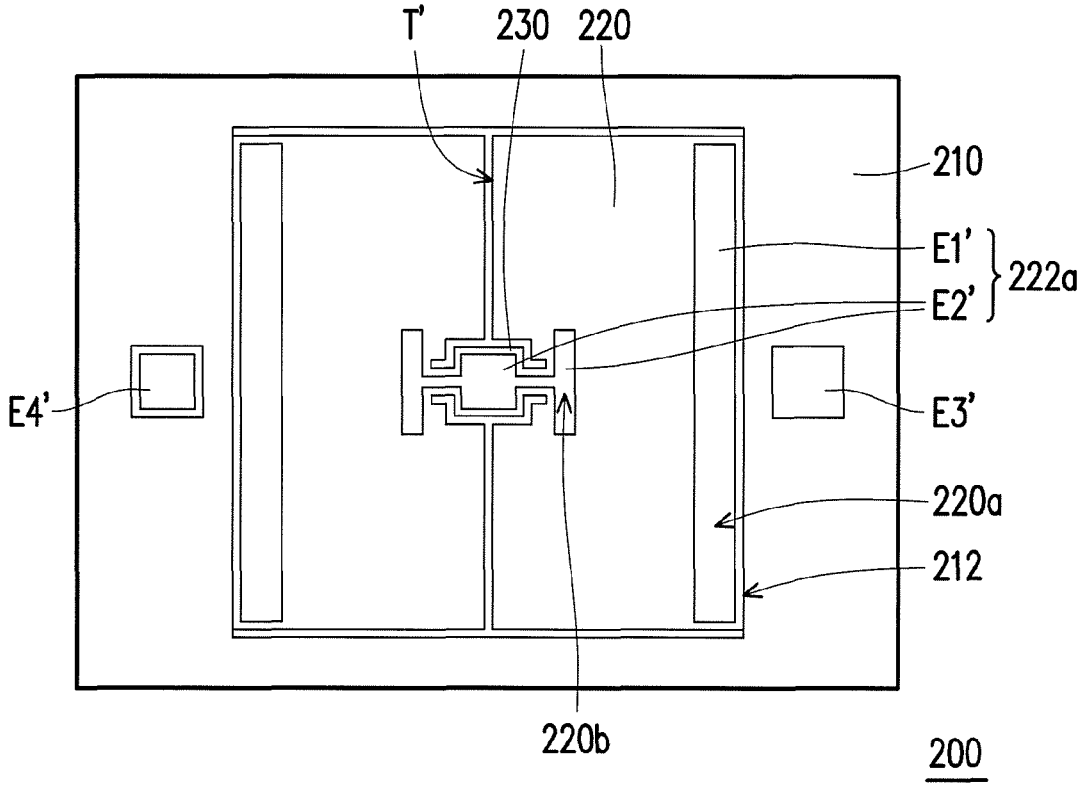
FIG. 3 is a schematic top view illustrating an electro-acoustic transducer according to another embodiment of the invention.

FIG. 3 is a schematic top view illustrating an electro-acoustic transducer according to another embodiment of the invention. In an electro-acoustic transducer 200 illustrated in FIG. 3, the disposition and operations of a base 210, an opening 212, vibration portions 220, a first connection end 220*a*, a second connection end 220*b*, an upper electrode layer 222*a*, a first electrode region E1', a second electrode region E2', electrodes E3' and E4', a connection portion 230, a trench T' are similar to those of the base 110, the opening 112, the vibration portions 120, the first connection end 120*a*, the second connection end 120*b*, the upper electrode layer 122*a*, the first electrode region E1, the second electrode region E2, the electrodes E3 and E4, the connection portion 130 and the trenches T illustrated in FIG. 1 and will not repeatedly described. The electro-acoustic transducer 200 is different from the electro-acoustic transducer 100 in that the number of the vibration portions 220 is two. In other embodiments, the electro-acoustic transducer may have other adaptive numbers of vibration portions, which is not limited in the invention.

Figure 4A:
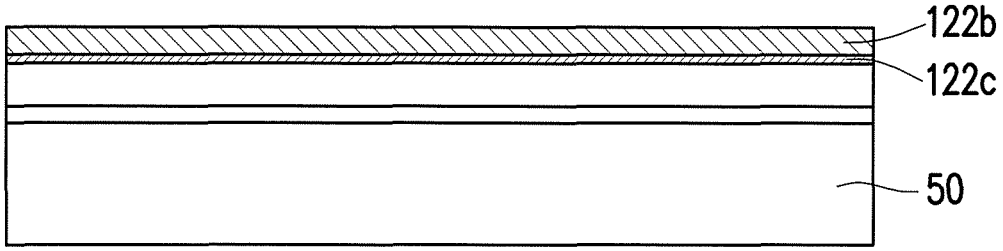
FIG. 4A to FIG. 4C are schematic views illustrating a manufacturing process of the electro-acoustic transducer depicted in FIG. 1.
Figure 4B:
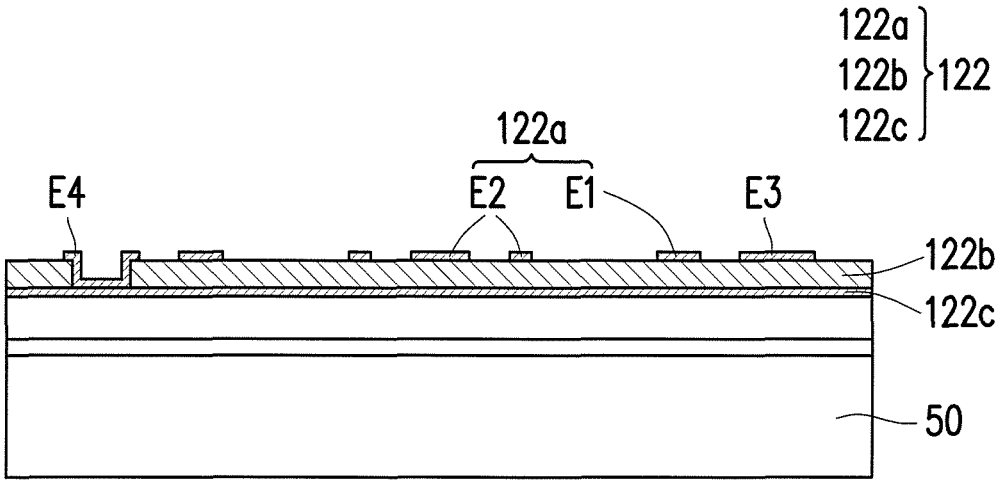
Figure 4C:
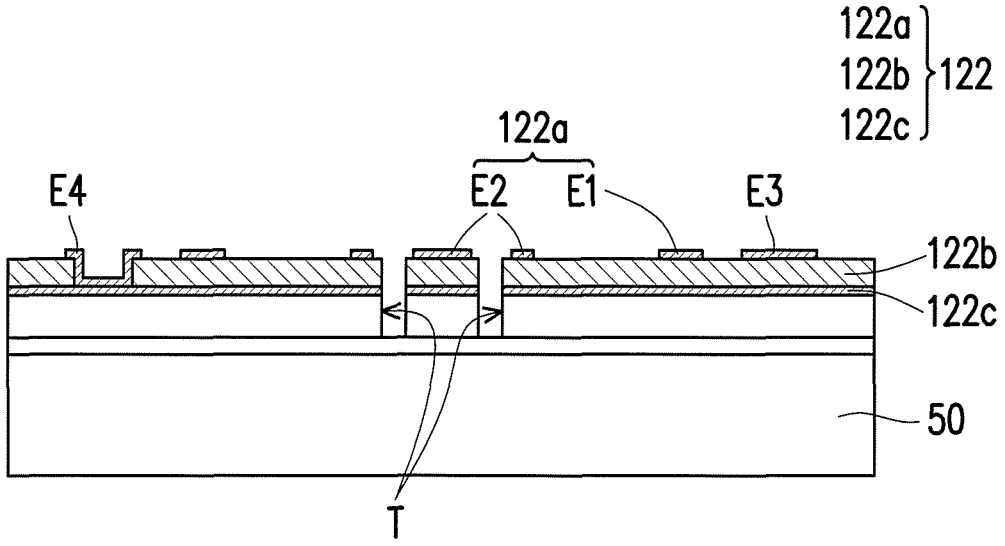

The electro-acoustic transducer 100 illustrated in FIG. 1 serves as an example below for describing a manufacturing process thereof. FIG. 4A to FIG. 4C are schematic views illustrating a manufacturing process of the electro-acoustic transducer depicted in FIG. 1. First, referring to FIG. 4A, a lower electrode layer 122*c* and a piezoelectric material layer 122*b* are formed on a substrate 50. Then, referring to FIG. 4B, an upper electrode layer 122*a* is formed on the piezoelectric material layer 122*b*. The upper electrode layer 122*a*, the piezoelectric material layer 122*b* and the lower electrode layer 122*c* form a piezoelectric transduction layer 122. The upper electrode layer 122*a* has a first electrode region E1 and a second electrode region E2, and the upper electrode layer 122*a* and the lower electrode layer 122*c* respectively have an electrode E3 and an electrode E4. The first electrode region E1, the second electrode region E2, the electrodes E3 and E4 are coplanar, for example. Referring to FIG. 4C, trenches T are formed in the substrate 50 and the piezoelectric transduction layer 122, and part of the substrate 50 is removed in a way as illustrated in FIG. 2 to separate and form a vibration portion 120 and a connection portion 130. For example, the trenches T are formed by a dry etching process, such that each trench T has a small width for avoid loss of the acoustic waves through the trenches T. However, the invention is not limited thereto. The trenches T may also be formed by an ion milling process or a deep reactive ion etching (DRIE) process.

Based on the above, in the electro-acoustic transducer of the invention, each of the vibration portions is not only connected to the base through the first connection end thereof, but also connected to the other vibration portions through the second connection end thereof and the connection portion. Namely, the first connection end and the second connection end of each of the vibration portions are not free ends, and when receiving acoustic waves or being actuated by electrical signals, the first connection end and the second connection end can generate stresses in reversed directions. In this way, the electrical signals with reversed phases can be respectively input from the first connection end and the second connection end to each piezoelectric transduction layer, such that strains are generated respectively at the first connection end and the second connection end of the piezoelectric transduction layer to drive the vibration portion to vibrate, and the electrical signals are input in a differential manner to the electro-acoustic transducer. Thereby, the strength and accuracy of outputting the acoustic waves can be improved. In addition, when the vibration portions receive acoustic waves to drive the piezoelectric transduction layer to deform, strains and electrical signals with reversed phases are generated respectively at the first connection end and the second connection end of the piezoelectric transduction layer, and the electrical signals are output in a differential manner. Thereby, the strength and accuracy of outputting the electrical signals can be improved. In this way, the electro-acoustic transducer can have good electro-acoustic transduction quality.

Although the invention has been disclosed by the above embodiments, they are not intended to limit the invention. It will be apparent to one of ordinary skill in the art that modifications and variations to the invention may be made without departing from the spirit and scope of the invention. Therefore, the scope of the invention will be defined by the appended claims.

What is claimed is:

1. An electro-acoustic transducer, comprising:

a base;

a plurality of vibration portions, wherein each of the vibration portions comprises a piezoelectric transduction layer and has a first connection end and a second connection end opposite to each other, and the first connection ends are connected to the base; and a connection portion, separated from the base and connected to the second connection ends, wherein the piezoelectric transduction layers are adapted to receive electrical signals to deform, such that the vibration portions are driven to vibrate and generate corresponding acoustic waves, and the vibration portions are adapted to receive acoustic waves to vibrate, such that the piezoelectric transduction layers are driven to deform and generate corresponding electrical signals, wherein each of the piezoelectric transduction layers comprises an upper electrode layer, a piezoelectric material layer and a lower electrode layer, and the piezoelectric material layer is disposed between the upper electrode layer and the lower electrode layer, and wherein the upper electrode layer comprises a first electrode region and a second electrode region, the first electrode region and the second electrode region are separated from each other, the first electrode region is aligned with the first connection end, and the second electrode region is aligned with the second connection end and the connection portion.

2. The electro-acoustic transducer according to claim 1, wherein the base has an opening, the vibration portions and the connection portion are located in the opening, and the first connection ends are connected to an inner edge of the opening.

3. The electro-acoustic transducer according to claim 1, wherein the vibration portions surround the connection portion.

4. The electro-acoustic transducer according to claim 1, wherein each of the vibration portions further comprises a carrying layer, the piezoelectric transduction layer is disposed on the carrying layer, the piezoelectric transduction layer is adapted to deform relatively to the carrying layer to drive the vibration portion to vibrate, and the vibration portion is adapted to vibrate to drive the piezoelectric transduction layer to deform relatively to the carrying layer.

5. The electro-acoustic transducer according to claim 4, wherein a material of the carrying layer comprises a non-piezoelectric material.

6. The electro-acoustic transducer according to claim 1, wherein the first electrode region is adapted to receive or output an electrical signal, the second electrode region is adapted to receive or output another electrical signal, and phases of the two electrical signals are reversed.

* * * * *